United States Patent [19]

Horiuchi et al.

[11] Patent Number: 4,569,787

[45] Date of Patent: Feb. 11, 1986

[54] PROCESS AND APPARATUS FOR TREATING RADIOACTIVE WASTE

[75] Inventors: Susumu Horiuchi, Hitachi; Mikio Hirano, Katsuta; Toru Saito, Hitachi, all of Japan

[73] Assignee: Hitachi, Ltd., Tokyo, Japan

[21] Appl. No.: 391,296

[22] Filed: Jun. 23, 1982

[51] Int. Cl.[4] ..... G21F 9/08

[52] U.S. Cl. ..... 252/632; 134/10; 159/DIG. 12; 264/0.5

[58] Field of Search ..... 252/632, 626, 631; 34/77, 79; 159/DIG. 12; 134/10, 33; 264/0.5

[56] References Cited

U.S. PATENT DOCUMENTS

| | | | |
|---|---|---|---|
| 4,184,959 | 2/1978 | Marmo | 252/626 |
| 4,234,448 | 11/1980 | Hirano et al. | 252/626 |
| 4,268,409 | 5/1981 | Ga et al. | 252/632 |
| 4,290,907 | 9/1981 | Horiuchi et al. | 252/632 |
| 4,290,908 | 9/1981 | Horiuchi et al. | 252/632 |
| 4,311,531 | 1/1982 | Bege et al. | 252/626 |

FOREIGN PATENT DOCUMENTS

| | | | |
|---|---|---|---|
| 2851231 | 5/1979 | Fed. Rep. of Germany | 252/632 |
| 0012680 | 5/1978 | Japan | 252/632 |
| 0103997 | 8/1979 | Japan | 252/632 |

*Primary Examiner*—Benjamin R. Padgett
*Assistant Examiner*—Howard J. Locker
*Attorney, Agent, or Firm*—Beall Law Offices

[57] ABSTRACT

A radioactive waste is treated by supplying a liquid concentrate of at least one of a radioactive liquid waste and a radioactive waste slurry to a centrifugal film dryer, thereby drying and pulverizing insoluble and soluble solid matters contained in the concentrate, washing the centrifugal film drier with hot water after the drying and pulverization, settling the effluent washing water together with a condensate containing solid matters generated in the drying and pulverization, and supplying a slurry of insoluble solid matters separated by the settling to the centrifugal film drier, thereby drying and pulverizing the solid matters. The dried powder from the centrifugal film drier can be pelletized in a pelletizer, and effluent washing water generated by washing the pelletizer with hot water after the pelletization can be subjected to the settling together with the effluent washing water and the condensate from the centrifugal film drier. Operating load of the centrifugal film drier is considerably reduced, and the operating efficiency and life of the centrifugal film drier are improved thereby.

14 Claims, 3 Drawing Figures

PROCESS AND APPARATUS FOR TREATING RADIOACTIVE WASTE

BACKGROUND OF THE INVENTION

This invention relates to a process and an apparatus for treating a radioactive waste, and particularly to a process and an apparatus for treating a radioactive waste by a centrifugal film drier.

Various radioactive wastes are generated in atomic power stations during their power generation and it has been so far proposed that a radioactive liquid waste containing sodium sulfate ($Na_2SO_4$) as the major component, and a radioactive waste slurry such as liquid wastes containing radioactive filter sludge, radioactive waste ion exchange resin are dried and pulverized alone or in mixture by a centrifugal film drier, and the resulting dried powder is mixed with a solidifying agent such as plastics, cement, asphalt, or the like, and filled in 200-l capacity drums for ultimate solidification, or the dried powder is pelletized for volume reduction, and solidified and stored in a tightly sealed state. However, actual technical economical problems for their commercialization, for example, large reduction of operating load of a centrifugal film drier, particularly, operating load pertaining to treatment of effluent washing water from the centrifugal film drier and/or from a pellelizer, and also of a condensate of vapors generated from the centrifugal film drier, have not been fully solved yet.

SUMMARY OF THE INVENTION

An object of the present invention is to greatly reduce the operating load of a centrifugal film drier in the treatment of a radioactive waste and to improve the operating efficiency and life of the expensive centrifugal film drier.

The present invention provides a process for treating a radioactive waste which comprises a step of supplying a concentrate of at least one of a radioactive liquid waste and a radioactive liquid slurry to a centrifugal film drier, thereby drying and pulverizing insoluble and soluble solid matters contained in the concentrate; a step of washing the centrifugal film drier with hot water after the drying and pulverization; a step of settling effluent washing water from the centrifugal film drier, together with a condensate containing solid matters generated by the drying and pulverization in the centrifugal film drier; and a step of supplying a slurry of insoluble solid matters separated by the settling to the centrifugal film drier, thereby drying and pulverizing the insoluble solid matters.

The present invention furthermore provides a process for treating a radioactive waste, which comprises, in addition to the afore-mentioned steps, a step of pelletizing the resulting dried powder in a pelletizer; a step of washing the pelletizer with hot water after the pelletization; and a step of settling effluent washing water from the pelletizer, together with the effluent washing water and the condensate from the centrifugal film drier.

The present invention still furthermore provides an apparatus for treating a radioactive waste, which comprises a feed tank, a centrifugal film drier connected to the feed tank, a mist separator connected to the upper part of the centrifugal film drier, a condenser connected to the mist separator, a settling tank connected to centrifugal film drier through a three-way valve, the settling tank being provided with a liquid circulating means.

The present invention still furthermore provides an apparatus for treating a radioactive waste, which comprises, in addition to the afore-mentioned members, a pelletizer connected to the bottom of the centrifugal film drier, the settling tank being connected to the outlet of the pelletizer through a three-way valve.

The present invention will be described in detail below, referring to the accompanying drawings.

Figure 1:
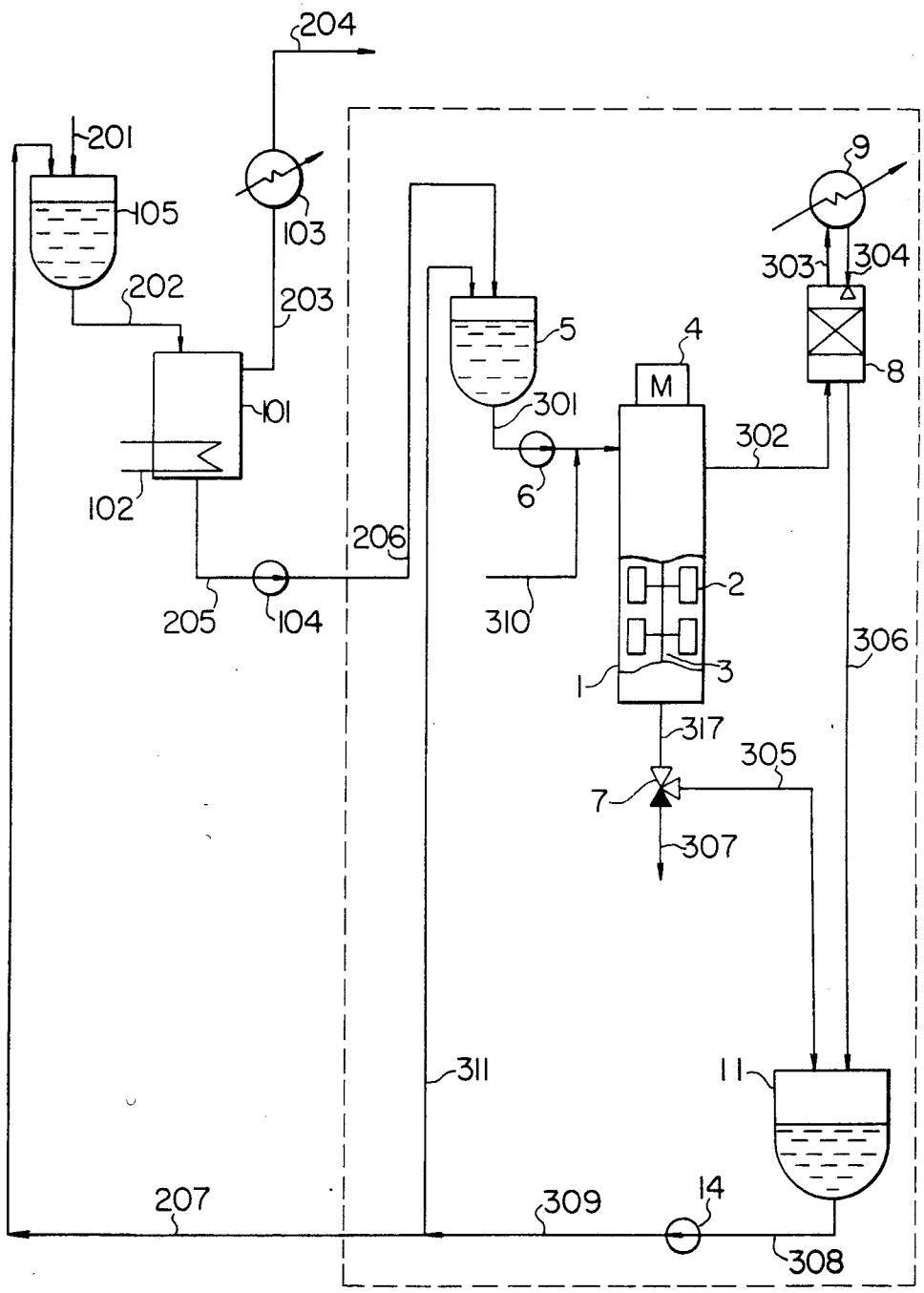
FIG. 1 is a flow diagram of a system for treating a radioactive waste, to which the present invention is applied.

A flow diagram of a system for treating a radioactive waste by a centrifugal film drier, to which the present invention is applied, is shown in FIG. 1. An aqueous radioactive waste containing about 1% by weight of solid matters, which comprises at least one of a radioactive liquid waste and a radioactive waste slurry is supplied to waste feed tank 105 through line 201, and then supplied therefrom to evaporator 101 provided with heater 102, at a predetermined feed rate through line 202, where the aqueous radioactive waste is evaporated and cencentrated at 65°–120° C. The generated vapor is led to condenser 103 through line 203 for condensation. The resulting condensate is monitored as to its electroconductivity and radioactivity, and discharged to the outside as such or post-treated through line 204, depending upon the results of monitoring. The concentrate from evaporator 101 contains about 10% by weight of solid matters, and is supplied to feed tank 5 through line 205, pump 104 and line 206, and then fed therefrom to the upper part of centrifugal film drier 1 through line 301 and pump 6. Centrifugal film drier 1 has rotating blades 2 supported by blade support 3, which is rotatable by motor 4. Three-way valve 7 is provided in outlet line 317 from centrifugal film drier 1 to withdraw dried powder. The upper part of centrifugal film drier 1 is connected to mist separator 8 through line 302 and further to condenser 9 through line 303.

The concentrate fed from feed tank 5 is dried and pulverized at 150°–180° C. in centrifugal film drier 1, and the resulting dried powder is discharged therefrom through line 317, three-way valve 7 and line 307. Water vapor generated by the drying and pulverization in the centrifugal film drier is led to mist separator 8 through line 302 and further to condenser 9 through line 303 for condensation. That is, the concentrate fed into centrifugal film drier 1 is pressed to the wall of centrifugal film drier 1 by rotating blades 2 to form a liquid film. The liquid film is evaporated and dried while it flows down along the wall by gravity, and the dried film is scraped off also by rotating blades 2 and recovered as dried powder. On the other hand, water vapor generated in centrifugal film drier 1 is led to mist separator 8 where powder and mists are separated from the water vapor, and then the water vapor is condensed in condenser 9. The resulting condensate is then refluxed to mist separator 8 to scrub the incoming water vapor from the centrifugal film drier, and then led to storage tank 11.

Since blade support 8 having blades 2 is inserted in the cylindrical drum of centrifugal film drier 1, and since the liquid concentrate is evaporated and dried therein with heating from the outside with aid of rotating blades 2, the dried powder flies up throughout the drum during the evaporating and drying operation, and accumulates or deposits as foulings on blade support 3, blade stems, heat transfer surface, etc. Thus, centrifugal film drier 1 must be cleaned, after treatment of the concentrate, to remove foulings from the blade support, heat transfer surface, etc. within the centrifugal film drier to maintain desired operating efficiency, particularly heat transfer efficiency. To this end, the centrifugal film drier is washed periodically.

Washing of centrifugal film drier 1 shown in FIG. 1 is carried out by introducing hot water into the drier through line 310 while rotating blades 2 of the drier, and effluent washing water is recovered into storage tank 11 through line 305 by switching three-way valve 7. Alternately, three-way valve 7 can be closed to fill the hot water in the drier while rotating blades 2 to wash the drier.

It has been found that about 5% by weight of solid content of the concentrate fed to the drier accumulates within the drier. The accumulated powder is washed into the washing water in the drier. It has been also found that the condensate leaving mist separator 8 for storage tank 11 contains about 1% by weight of the solid content of the concentrate fed to the drier. In other words, the effluent washing water and the condensate of water vapor from the centrifugal film drier contain pulverized sodium sulfate, filter sludge and ion exchange resin as dissolved or suspended, and thus must be treated again.

To this end, the water recovered in storage tank 11 is usually returned to waste feed tank 105 through line 308, pump 14, line 309, and line 207, or to feed tank 5 through line 311. However, the volume of the effluent washing water from centrifugal film drier 1 and the condensate of vapor generated in centrifugal film drier 1 is at least equal to the volume of the concentrate to be treated in centrifugal film drier 1, and, thus, when the water in storage tank 11 is returned to feed tank 5, the operating time necessary for treating the concentrate in centrifugal film drier 1 is reduced to about 50%. Such recycling makes drier operating efficiency and economy lower. On the other hand, when it is returned to waste feed tank 105, the resin powder, etc. in the water undergo thermal decomposition by evaporation and concentration in evaporator 101 to generate volatile organic matters such as trimethylamine, etc., and the volatile organic matters dissolve in condensate of the generated vapor. When such dissolution, so-called carrier-over, takes place, the quality (electroconductivity, pH, etc.) of condensate is lowered, or heater 102 or wall of evaporator 101 is attacked by the organic matters, leading to corrosion.

The present invention is based on the results of studies of such troubles as encountered in the system for treating a radioactive waste.

The present invention will be described in detail below, referring to embodiments.

PREFERRED EMBODIMENTS OF THE INVENTION

Figure 2:
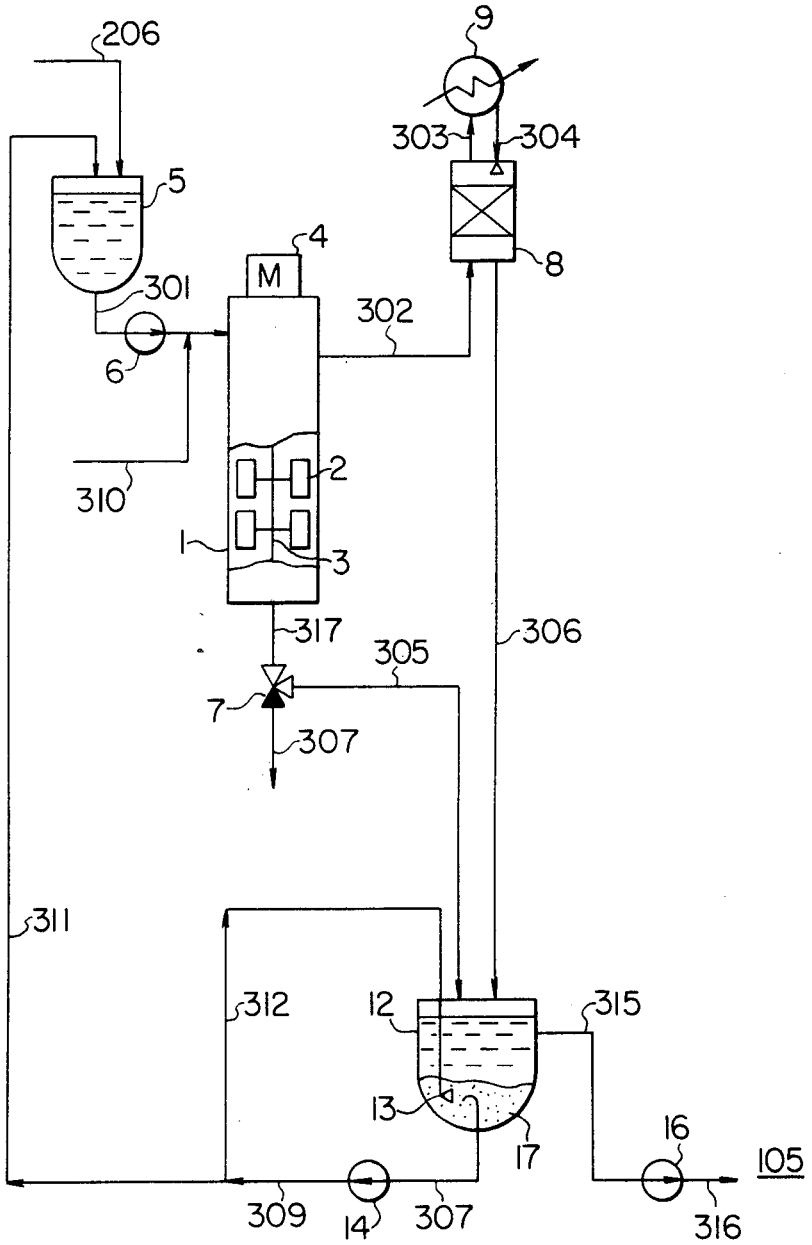
FIGS. 2 and 3 are flow diagrams showing different embodiments of the present invention.

FIG. 2 shows a flow diagram of one embodiment of carrying out the present invention, which corresponds to the members in the dotted frame of FIG. 1, where the same members as in FIG. 1 are represented by the same reference numerals. In the system of FIG. 2, settling tank 12 is provided in place of storage tank 11 of FIG. 1, and the condensate containing solid matters from centrifugal film drier 1 and the effluent washing water therefrom are supplied to settling tank 12, which is provided with lines 307, 309 and 311 for returning a slurry of solid matters settled down at the bottom of the settling tank through stirring ejector 13 provided near the bottom of the settling tank and through return pump 14, and also provided with decanter line 315 at the upper part of the settling tank to discharge clear water through decantor pump 16 and line 136.

Settling tank 12 has a capacity to store a predetermined volume of the condensate and the effluent washing water. The condensate and effluent washing water are settled in settling tank 12 for a time enough to settle down the solid matters. The resulting clear water is transferred to waste feed tank 105 through decantor pump 16 and line 316. Settling operation is repeated until the settled solid matters take a predetermined proportion, i.e. about 10% by volume of the total capacity of the settling tank. Then, the water in the settling tank is stirred by ejection through stirring ejector 13 by driving return pump 14, and the resulting homogenized slurry is recycled to feed tank 5 and then fed to centrifugal film drier 1 for drying and pulverization.

The proportion of insoluble solid matters settled down in settling tank 12 is desirably 5–15% by volume of the total capacity of the settling tank. The operating efficiency will be below 5% by volume, whereas the transfer to feed tank 5 will be difficult above 15% by volume.

In the foregoing embodiment, drying and pulverization treatment of the effluent washing water and the condensate from centrifugal film drier 1, which is carried out in the system of FIG. 1 every time when the centrifugal film drier is washed, is not required for each washing, and thus, a proportion of operating load pertaining to the treatment of effluent washing water can be considerably reduced. This reduction makes it possible to commercially treat a radioactive waste in a centrifugal film drier.

Figure 3:
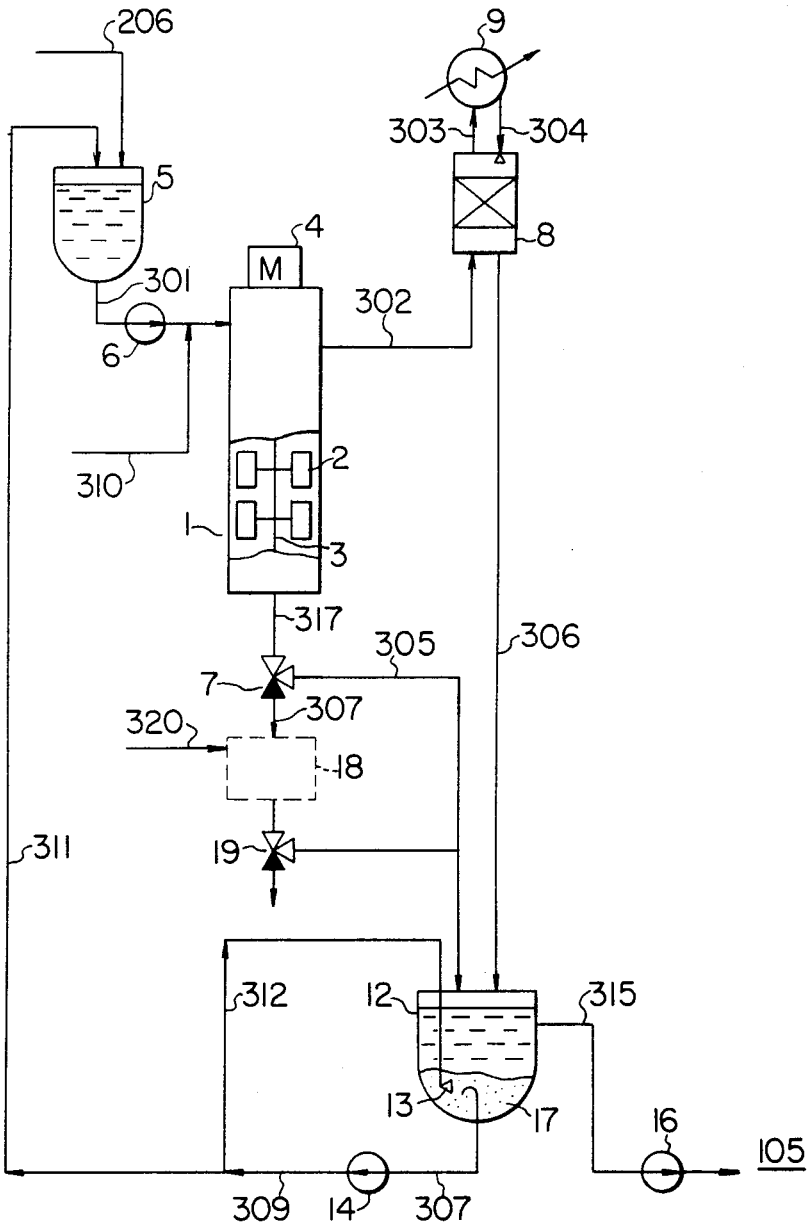

In FIG. 3, a flow diagram of another embodiment of the present invention is shown, where the same members as in FIG. 2 are represented by the same reference numerals. Only distinction from the embodiment of FIG. 2 is an additional treatment of effluent washing water generated by washing with hot water a pelletizer provided in the outlet line from the centrifugal film drier to pelletize dried powder from the drier.

In FIG. 3, numeral 18 is a pelletizer, and 19 a three-way valve provided in the line for transferring the pellets from pelletizer to successive storage in a sealed state and also for leading effluent washing water from the pelletizer to settling tank 12.

Pelletizer 18 is washed with hot water fed through washing water line 320, and the solid powder accumulated in pelletizer 18 is washed into the washing water, and the resulting effluent washing water flows into settling tank 12 through three-way valve 19. In settling tank 12, the effluent washing water from the pelletizer is mixed with the effluent washing water and the condensate from the centrifugal film drier, and treated in the same manner with the same effect as in the foregoing embodiment.

As described above, the present invention makes it possible to commercially carry out treatment of a radioactive waste in a centrifugal film drier with considerable reduction in proportion of an operating load pertaining to the treatment of the effluent washing water and the condensate from the centrifugal film drier as well as of the effluent washing water from the pelletizer. Thus, the present invention has a large commercial effect.

What is claimed is:

1. A process for treating radioactive waste comprising the steps of:

providing radioactive waste comprising at least one of radioactive liquid waste and radioactive waste slurry each comprising solid matter and water;

conducting the radioactive waste to a first waste feed tank;

evaporating a portion of the water in an evaporator;

withdrawing the evaporated water;

conducting the waste from the evaporator to a second waste feed tank;

conducting the waste from the second waste feed tank to the upper part of a centrifugal film dryer wherein the waste solution forms a film on the inner wall of the dryer, the water vaporizes and is withdrawn and condensed in a condenser, the remaining solid matter forms a dry film on said wall and rotating blades scrap the dry solid matter from said wall to form a dry powder which accumulates at the lower part of the dryer with a portion of said powder depositing on said rotating blades and other members located interior the dryer;

withdrawing the accumulated powder;

washing the interior of the centrifugal film dryer with hot water to remove the deposited powder;

conducting the hot water from the centrifugal film dryer and water from the condenser to a storage tank; and conducting the material from the storage tank to the first waste feed tank to be treated as radioactive waste.

2. The process according to claim 1, wherein the step of washing the centrifugal film drier is carried out periodically.

3. A process according to claim 1, wherein the storage tank is a settling tank wherein solid matter settles to the bottom of the tank with clear water above it and further wherein the clear water is conducted to the first waste tank to be treated as radioactive waste and a concentrated slurry of the solid matter is conducted to the second waste feed tank to be treated as radioactive waste.

4. A process according to claim 3, wherein the amount of solid matter in the slurry is 5–15% by volume of the total capacity of the settling tank.

5. A process according to claim 1, wherein, before it is condensed, the vaporized water is led to a mist separator to separate powder and mist therefrom and, after it is condensed, the resulting liquid condensate is refluxed to the mist separator to scrub the incoming vaporized water withdrawn from the centrifugal film dryer.

6. A process according to claim 1, wherein the radioactive waste in the providing step comprises 1% solid matter and comprises 10% solid matter after the evaporating step.

7. A process according to claim 1, wherein the temperature in the evaporator is 65° to 120° C. and the temperature in the centrifugal film dryer is 150° to 180° C.

8. A process for treating radioactive waste comprising the steps of:

providing radioactive waste comprising at least one of radioactive liquid waste and radioactive waste slurry each comprising solid matter and water;

conducting the radioactive waste to a first waste feed tank;

evaporating a portion of the water in an evaporator;

withdrawing the evaporated water;

conducting the waste from the evaporator to a second waste feed tank;

conducting the waste from the second waste feed tank to the upper part of a centrifugal film dryer wherein the waste solution forms a film on the inner wall of the dryer, the water vaporizes and is withdrawn and condensed in a condenser, the remaining solid matter forms a dry film on said wall and rotating blades scrap the dry solid matter from said wall to form a dry powder which accumulates at the lower part of the dryer with a portion of said powder depositing on said rotating blades and other members located interior the dryer;

withdrawing the accumulated powder;

forming the withdrawn powder into pellets in a pelletizer, with a portion of said powder depositing on the interior members of the pelletizer;

withdrawing the pellets to storage;

washing the interior of the centrifugal film dryer with hot water to remove the deposited powder;

washing the interior of the pelletizer with hot water to remove the deposited powder;

conducting the hot water from the centrifugal film dryer, the hot water from the pelletizer and water from the condenser to a storage tank; and conducting the material from the storage tank to the first waste feed tank to be treated as radioactive waste.

9. The process according to claim 8, wherein the step of washing the centrifugal film drier and the pelletizer is carried out periodically.

10. A process according to claim 8, wherein the storage tank is a settling tank wherein solid matter settles to the bottom of the tank with clear water above it and further wherein the clear water is conducted to the first waste tank to be treated as radioactive waste and a concentrated slurry of the solid matter is conducted to the second waste feed tank to be treated as radioactive waste.

11. A process according to claim 8, wherein the amount of solid matter in the slurry is 5–15% by volume of the total capacity of the settling tank.

12. A process according to claim 8, wherein, before it is condensed, the vaporized water is led to a mist separator to separate powder and mist therefrom and, after it is condensed, the resulting liquid condensate is refluxed to the mist separator to scrub the incoming vaporized water withdrawn from the centrifugal film dryer.

13. A process according to claim 8, wherein the radioactive waste in the providing step comprises 1% solid matter and comprises 10% solid matter after the evaporating step.

14. A process according to claim 8, wherein the temperature in the evaporator is 65° to 120° C. and the temperature in the centrifugal film dryer is 150° to 180° C.

* * * * *